US010145028B2

(12) United States Patent
Choi et al.

(10) Patent No.: US 10,145,028 B2
(45) Date of Patent: Dec. 4, 2018

(54) CONTINUOUS CARBON FIBER/THERMOPLASTIC RESIN FIBER COMPOSITE YARN AND METHOD FOR MANUFACTURING THE SAME

(71) Applicant: Hyundai Motor Company, Seoul (KR)

(72) Inventors: Young-Ho Choi, Gyeonggi-do (KR); Chi-Hoon Choi, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 626 days.

(21) Appl. No.: 14/145,008

(22) Filed: Dec. 31, 2013

(65) Prior Publication Data

US 2014/0329086 A1 Nov. 6, 2014

(30) Foreign Application Priority Data

May 6, 2013 (KR) ..... 10-2013-0050401

(51) Int. Cl.
*D01F 8/12* (2006.01)
*D01F 8/06* (2006.01)
(Continued)

(52) U.S. Cl.
CPC ..... *D01F 8/12* (2013.01); *D01F 8/06* (2013.01); *D02G 1/0286* (2013.01); *D02G 3/045* (2013.01);
(Continued)

(58) Field of Classification Search
CPC .. D01F 8/12; D01F 8/06; D02G 3/045; D02G 3/042; D02G 1/0286; D02G 1/02; D02G 1/0206; D10B 2101/12; D10B 2331/02; D10B 2331/021; D10B 2321/022; D01H 1/11; D01H 1/115; D01H 7/92
See application file for complete search history.

(56) References Cited

U.S. PATENT DOCUMENTS 2,401,291 A * 5/1946 Smith ..... A63B 51/02 124/90
4,084,399 A * 4/1978 Kanemaru ..... A63B 51/02 273/DIG. 23

(Continued)

FOREIGN PATENT DOCUMENTS

JP 09-324331 A 12/1997
KR 10-0127866 10/1997
KR 10-1999-0071453 9/1999

OTHER PUBLICATIONS

International Tennis Federation Rules of Tennis, App'x II (2015), available at ITFtennis.com/technical/publications/rules/rackets/appendix-ii.aspx*

*Primary Examiner* — Scott R. Walshon
(74) *Attorney, Agent, or Firm* — Mintz Levin Cohn Ferris Glovsky and Popeo, P.C.; Peter F. Corless

(57) ABSTRACT

Disclosed is a continuous carbon fiber/thermoplastic resin fiber composite yarn and a method for manufacturing the same, wherein the carbon fiber composite yarn provides excellent mechanical properties, is light in weight, moldable, and has excellent impregnating ability. In particular, the composite yarn is provided with these superior properties by including a continuous carbon fiber having excellent mechanical properties, a thermoplastic resin fiber, and the like, and by using a false twist processing machine or a solution bath, and the like in order to manufacture the composite yarn.

1 Claim, 4 Drawing Sheets

(51) Int. Cl.

| | |
|---|---|
| ***D02G 3/38*** | (2006.01) |
| ***D02G 1/02*** | (2006.01) |
| ***D02G 3/04*** | (2006.01) |
| ***D02J 1/18*** | (2006.01) |
| ***D06B 3/02*** | (2006.01) |
| ***D02G 3/16*** | (2006.01) |
| ***D02G 3/40*** | (2006.01) |
| *D01H 1/11* | (2006.01) |

(52) U.S. Cl.

CPC ..... *D02G 3/16* (2013.01); *D02G 3/38* (2013.01); *D02G 3/402* (2013.01); *D02J 1/18* (2013.01); *D06B 3/02* (2013.01); *D01H 1/11* (2013.01); *D02G 1/0206* (2013.01); *D10B 2101/12* (2013.01); *D10B 2321/022* (2013.01); *D10B 2331/02* (2013.01); *D10B 2331/021* (2013.01); *D10B 2505/02* (2013.01); *Y10T 428/2918* (2015.01)

(56) References Cited

U.S. PATENT DOCUMENTS

| | | | | |
|---|---|---|---|---|
| 4,800,113 | A * | 1/1989 | O'Connor | B29B 15/105 156/148 |
| 4,874,563 | A | 10/1989 | McMahon et al. | |
| 5,177,840 | A * | 1/1993 | Laws | D02G 3/402 28/167 |
| 5,313,774 | A * | 5/1994 | Matsumoto | D02G 3/045 139/420 R |
| 5,355,567 | A * | 10/1994 | Holliday | B29C 70/16 156/148 |
| 6,251,809 | B1 * | 6/2001 | Creasy | B29C 70/14 428/196 |
| 8,709,562 | B2 * | 4/2014 | Nguyen | D01F 6/04 428/222 |
| 2009/0053442 | A1 * | 2/2009 | Nguyen | D01F 6/04 428/36.3 |

* cited by examiner

CONTINUOUS CARBON FIBER/THERMOPLASTIC RESIN FIBER COMPOSITE YARN AND METHOD FOR MANUFACTURING THE SAME

CROSS-REFERENCE TO RELATED APPLICATIONS

This application claims priority under 35 U.S.C. § 119 to Korean Patent Application No. 10-2013-0050401, filed on May 6, 2013, in the Korean Intellectual Property Office, the disclosure of which is incorporated herein by reference in its entirety.

BACKGROUND OF THE INVENTION

1. Field of the Invention

The present invention relates to a continuous carbon fiber/thermoplastic resin fiber composite yarn and a method for manufacturing the same. More particularly, the present invention relates to a continuous carbon fiber/thermoplastic resin fiber composite yarn having excellent mechanical properties, being light in weight, and having excellent moldability and impregnating ability by including a continuous carbon fiber and a thermoplastic resin fiber.

2. Description of the Related Art

In view of the environmental impact of transportation means such as automobiles and aircraft, reduction in the amount of energy consumed and the amount of carbon dioxide emitted is required. Further, improvement in fuel efficiency is required through the use of light weight components. As such, numerous studies have been conducted on the development of a composite material for automobiles which includes carbon fiber for implementing light weight properties.

Carbon fiber is an advanced material that weighs about 80 percent less and is 10 times stronger than steel, and has much higher tensile strength, tensile modulus, and the like compared with other fibers and further has excellent specific strength and specific modulus. As such, carbon fiber is appropriate for use as a reinforcing material of a composite material. Further, since carbon fiber has excellent heat resistance, chemical stability, electrical conductivity, flexibility, and the like, a variety of applications are available in various fields such as not only aerospace, aviation, wind power generation, and sports and leisure industry, but also medical and construction. Further, a carbon fiber having excellent interfacial adhesion is a material that may be used as a main material in a polymer composite material.

In a polymer composite material of carbon fiber, a carbon fiber/thermoset resin composite material has a disadvantage in that a product needs to be manufactured by molding at one time, and a further disadvantage in that there is a restriction on maintenance and recycling because the carbon fiber/thermoset resin composite material has a three-dimensional crosslinked network structure in which the material does not dissolve after being cured. A carbon fiber/thermoplastic resin composite material is advantageous in that the material provides high toughness, high-speed moldability, easy post-processability, recyclability, and the like. However, a carbon fiber/thermoplastic resin composite material has a disadvantage in that the resin has high viscosity and it is difficult to impregnate the thermoplastic resin into the carbon fiber. In order to solve the aforementioned problem, it is necessary to develop a carbon fiber/thermoplastic resin composite material and a manufacturing technology thereof.

In general, in the case of a carbon fiber, it is difficult to form a tow composed of bundles from 3,000 strands to 320,000 strands of a carbon fiber having a diameter of about 7 micrometers and to obtain an interlacing in which thermoplastic resin fibers are mixed together between carbon staple fibers of the tow.

In order to solve the aforementioned problem, a process illustrated in FIG. 1 has been used in the related art. FIG. 1 is a schematic view of a process by which a composite yarn in the related art is manufactured. More specifically, a composite yarn 12 has been manufactured by interlacing a glass fiber 10 having a continuous fiber form with a thermoplastic resin fiber 11. Alternatively, a composite yarn 12 has been manufactured by interlacing a carbon staple fiber 13 with a thermoplastic resin fiber 11. The composite yarn 12 manufactured from the glass fiber 10 and the thermoplastic resin fiber 11 is disadvantageous in that it has a higher specific weight and lower strength than a composite yarn manufactured from a carbon fiber. In addition, the composite yarn 12 manufactured from the carbon staple fiber 13 and the thermoplastic resin fiber 11 is disadvantageous in that it has lower physical properties than a composite yarn manufactured from a continuous carbon fiber having a continuous fiber form in carbon fiber.

SUMMARY OF THE INVENTION

The present invention has been made in an effort to provide a carbon fiber composite yarn having excellent mechanical properties, lightweight properties, moldability and impregnating ability. In particular, the present invention provides such a carbon fiber composite yarn and a method for manufacturing the same by including a continuous carbon fiber, a thermoplastic resin fiber, and the like and by using a false twist processing machine or a solution bath, and the like in order to manufacture the composite yarn.

According to one aspect, the present invention provides a composite yarn including a carbon fiber and a thermoplastic resin fiber, in which the carbon fiber is a continuous carbon fiber has a continuous fiber form.

According to various embodiments, it is preferred that the thermoplastic resin fiber is produced from one or more materials selected from the group consisting of polypropylene, polyamide 6, polyamide 66, polyamide 610, and polyester.

According to various embodiments, it is preferred that the thermoplastic resin fiber has an average thickness from about 0.5 denier to about 5 denier.

According to various embodiments, it is preferred that the thermoplastic resin staple fiber has an aspect ratio from about 100 to about 10,000.

In addition, it is preferred that the composite yarn has a twist number from about 50 turns/meter (T/M) to about 500 T/M.

According to another aspect, the present invention provides a method for manufacturing a continuous carbon fiber/thermoplastic resin fiber composite yarn, the method including: filament spreading each of a thermoplastic resin fiber tow and a continuous carbon fiber tow having a filament number from about 3,000 to about 25,000; and manufacturing a composite yarn by interlacing the filament spread continuous carbon fiber tow with thermoplastic resin fiber tow. Preferably, the filament spreading is carried out by using a friction disc being capable of being freely rotated without being subjected to restriction of a shaft and having a low friction coefficient. Further, it is preferred that the interlacing is carried out using a friction disc being rotated at the same rotation number as the shaft and having a high friction coefficient.

A composite yarn, in which a continuous carbon fiber and a thermoplastic resin fiber are mixed together, is then manufactured by passing a continuous carbon fiber tow having a filament number from about 25,000 to about 320,000 through a solution bath including a compatibilizer.

At this time, when the thermoplastic resin fiber has a continuous fiber form, it is preferred that the composite yarn is manufactured by interlacing the continuous carbon fiber tow with the thermoplastic resin fiber tow, and then passing the interlaced fiber through the solution bath. Furthermore, when the thermoplastic resin fiber has a staple fiber form, it is preferred that the composite yarn is manufactured by passing the continuous carbon fiber tow through the solution bath, and then interlacing the continuous carbon fiber tow with a thermoplastic resin fiber sliver. As referred to herein, a thermoplastic resin fiber sliver is generally understood to mean a strand of loose, untwisted fibers produced in carding.

According to the exemplary embodiments of the present invention, it is possible to obtain excellent mechanical properties when a molded article is manufactured from a composite yarn according to the present invention, particularly because a carbon fiber having excellent mechanical properties is present in the form of a continuous fiber.

Further, since the molded article manufactured from the composite yarn according to the present invention is lighter in weight than steel while still satisfying the same or comparable tensile strength and tensile modulus, the present invention provides a suitable molded article that is lightweight.

In addition, since the composite yarn according to the present invention is flexible, there is an effect that it is possible to use the composite yarn to implement various shapes. Still further, since it is possible to achieve fast molding using the composite yarn of the present invention by subjecting the composite yarn to a heating and solidification process, there is an effect that moldability is excellent.

Furthermore, since the present invention allows for distribution of a continuous carbon fiber uniformly among a thermoplastic resin, there is an effect that the impregnating ability is excellent.

Other aspects and exemplary embodiments of the invention are discussed infra.

BRIEF DESCRIPTION OF DRAWINGS

The above and other features and advantages of the present invention will become more apparent by describing in detail exemplary embodiments thereof with reference to the attached drawings in which.

Figure 1:
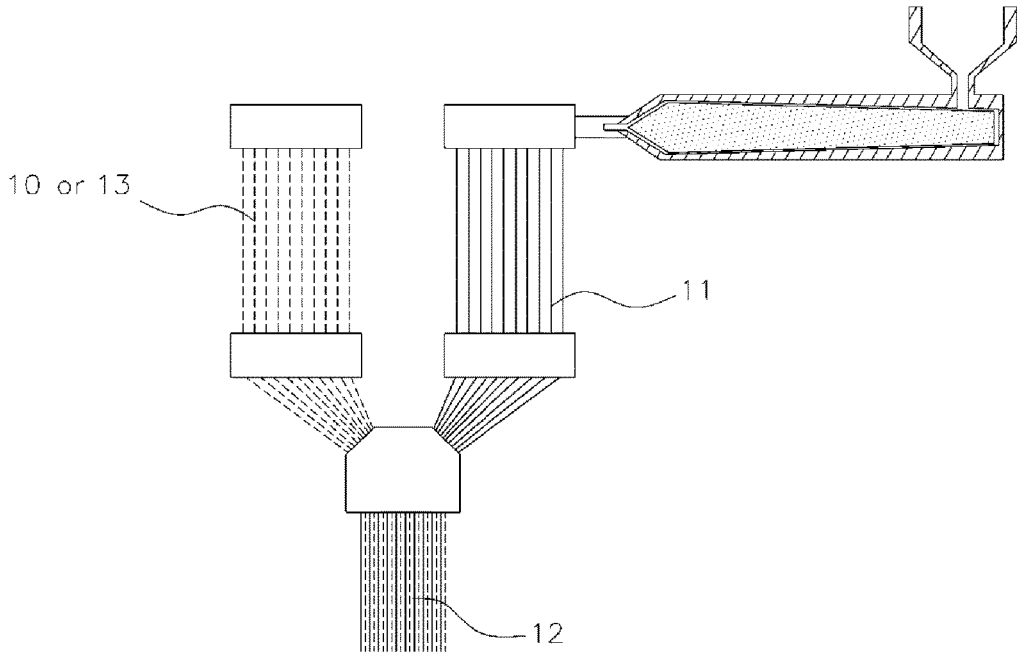
PRIOR ART FIG. 1
FIG. 1 is a schematic view of a conventional process by which a composite yarn in the related art is manufactured.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE EMBODIMENTS

Terms or words used in the present specification and claims should not be interpreted as being limited to typical or dictionary meanings, but should be interpreted as meanings and concepts which comply with the technical spirit of the present invention, based on the principle that an inventor can appropriately define a concept of a term to describe his/her own invention in the best manner.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about".

Hereinafter, the present invention will be described in detail with reference to drawings and a Table. The present invention relates to a continuous carbon fiber/thermoplastic resin fiber composite yarn and a method for manufacturing the same.

In an aspect, the present invention relates to a continuous carbon fiber/thermoplastic resin fiber composite yarn.

In particular, the composite yarn of the present invention includes a continuous carbon fiber, a thermoplastic resin fiber, and the like.

In the composite yarn including a carbon fiber and a thermoplastic resin fiber, it is possible to manufacture a composite yarn having excellent mechanical properties, being light in weight, and having various shapes at a high production speed. It is preferred that the carbon fiber is a continuous carbon fiber having a continuous fiber form rather than a staple fiber form to provide excellent impregnating ability of the carbon fiber and the thermoplastic resin.

According to the present invention, any thermoplastic resin fiber known in the art may suitably be used. According to, preferred embodiments, the thermoplastic resin fiber is produced from one or more materials selected from the group consisting of polypropylene, polyamide 6, polyamide 66, polyamide 610, and polyester.

According to preferred embodiments, the thermoplastic resin fiber has an average thickness from about 0.5 denier to about 5 denier, and more preferably from about 1 denier to about 3 denier. When the average thickness of the thermoplastic resin fiber is less than 0.5 denier, there is a problem in that the productivity of the composite yarn is decreased. On the other hand, when the average thickness exceeds 5 denier, it may be difficult to interlace the thermoplastic resin fiber with the carbon fiber due to a big difference in diameter between the thermoplastic resin fiber and the carbon fiber.

According to various embodiments, the thermoplastic resin staple fiber has an aspect ratio preferably from about 100 to about 10,000, and more preferably from about 500 to about 2,000. When the aspect ratio of the thermoplastic resin fiber is less than 100, it becomes difficult to interlace the thermoplastic resin staple fiber with the carbon fiber. On the other hand, when the aspect ratio exceeds 10,000, it may be difficult to distribute the thermoplastic resin fiber in the solution and to treat the thermoplastic resin fiber during the use thereof.

Furthermore, in the manufacturing of the composite yarn, the thickness of the composite yarn is not particularly limited. However, according to preferred embodiments, the thickness of the composite yarn is from about 2,600 denier to about 60,000 denier.

It is preferred that the composite yarn is twisted in order to improve the tensile strength of the composite yarn composed of the continuous carbon fiber, the thermoplastic resin fiber, and the like. The degree of twisting may be expressed as a twist number, which means the number of revolutions per meter of the composite yarn. The twist number of the composite yarn according to the present invention is preferably from about 50 turns/meter (T/M) to about 500 T/M, and more preferably from about 100 T/M to about 200 T/M. When the twist number of the composite yarn is less than 50 T/M, the composite yarn with interlaced fibers may lose integrity. On the other hand, when the twist number exceeds 500 T/M, the continuous carbon fiber may be damaged due to excessive twisting because the carbon fiber of the composite yarn is susceptible to shearing force.

Hereinafter, in another aspect, the present invention relates to a method for manufacturing a continuous carbon fiber/thermoplastic resin fiber composite yarn.

According to embodiments of the present invention, a composite yarn is provided which includes a continuous carbon fiber, a thermoplastic resin fiber, and the like. Any thermoplastic resin fiber known in the art may suitably be used. According to preferred embodiments, the thermoplastic resin fiber is produced from one or more materials selected from the group consisting of polypropylene, polyamide 6, polyamide 66, polyamide 610, and polyester.

A fiber bundle composed of a plurality of untwisted filaments, such as the continuous carbon fiber, is referred to as a tow. According to the present invention, another method for interlacing is applied in order to manufacture a continuous carbon fiber/thermoplastic resin fiber composite yarn according to the size of the continuous carbon fiber tow.

In particular, when the continuous carbon fiber tow has a filament number from about 3,000 to about 25,000, it is preferred that a continuous carbon fiber/thermoplastic resin fiber composite yarn is manufactured by interlacing the carbon fiber with the thermoplastic resin fiber by a false twist method using a false twist processing machine including a friction disc. When the filament number of the tow is less than 3,000, the manufacturing cost is increased due to a low production rate. On the other hand, when the number exceeds 25,000, the tow of the continuous carbon fiber is excessively thick, so that it may be difficult to perform filament spreading and interlacing of fibers using a friction disc.

Figure 2:
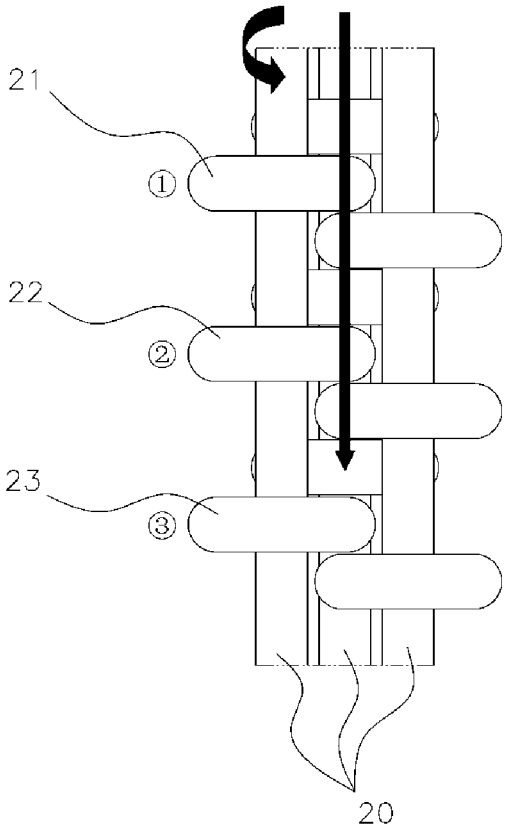
FIG. 2 is a view illustrating a friction disc and a rotating shaft of a false twist processing machine for manufacturing the composite yarn according to an embodiment of the present invention.

More specifically, FIG. 2 is a view illustrating a friction disc and a rotating shaft of a false twist processing machine for manufacturing the composite yarn according to an embodiment of the present invention. As shown, a shaft 20 includes a friction disc (e.g., 21, 22, 23). In the present invention, the numbers of shafts 20 and friction discs 21, 22, 23 are not particularly limited. According to one preferred embodiment, three shafts 20 are provided, and it is preferred that three friction discs 21, 22, 23 are included on each shaft 20.

Figure 3:
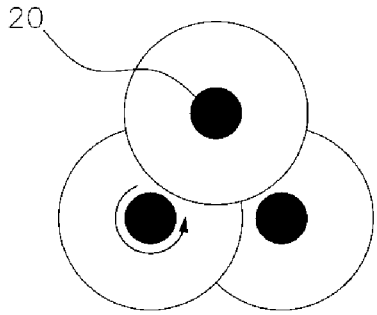
FIG. 3 is a plan view of shafts adjacent to each other and discs included in the shafts according to an embodiment of the present invention.

FIG. 3 is a plan view of the shafts 20, which are adjacent to each other, with discs included on each of the shafts. In particular, shafts 20 are adjacent to each other, and it is preferred that friction discs 21, 22, 23 included on the shafts are also adjacent to each other and intersect upward and downward.

Figure 4:
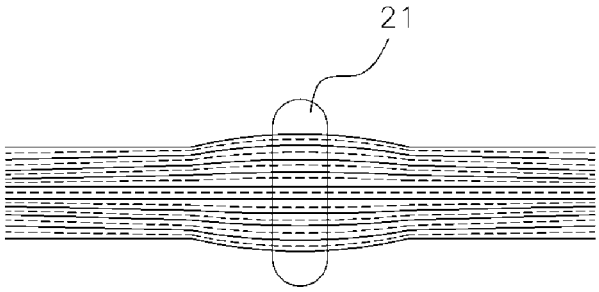
FIG. 4 is a view illustrating the filament spreading of the fiber by a No. 1 friction disc according to an embodiment of the present invention.

According to preferred embodiments, the uppermost No. 1 friction disc 21 among the three friction discs 21, 22, 23 included on each of the shafts 20 is capable of being freely rotated without being subjected to restriction of the shaft. As such, the uppermost No. 1 friction disc 21 is a friction disc having a low friction coefficient. According to the present invention, the continuous carbon fiber tow and the thermoplastic resin fiber tow may be each subjected to filament spreading on the curved surfaces of the friction disc. FIG. 4 is a view illustrating the filament spreading of the fiber by the No. 1 friction disc 21. As shown, the tow is subjected to filament spreading by the curved surface of the friction disc 21.

Further, the No. 2 friction disc 22 and the No. 3 friction disc 23 disposed at the middle and the bottom of the three friction discs included on each of the shafts 20 are friction discs having a high friction coefficient relative to that of the No. 1 friction disc. The Nos. 2 and 3 friction discs 22, 23 are rotated at the same revolution number as the shaft 20. As such, a continuous carbon fiber/thermoplastic resin fiber composite yarn may be manufactured because the filament spread continuous carbon fiber tow and the thermoplastic resin fiber tow are intersected with each other and twisted, and interlaced while passing through the curved surface of the rotating friction discs 21, 22, 23.

Accordingly, the present invention includes: filament spreading a thermoplastic resin fiber tow and a continuous carbon fiber tow having a filament number from about 3,000 to about 25,000 by using a curved surface of a No. 1 friction disc that freely rotates without being subjected to restriction of a shaft on which it is disposed, the disc having a low friction coefficient; and manufacturing a continuous carbon fiber/thermoplastic resin fiber composite yarn by interlacing the filament spread continuous carbon fiber tow with thermoplastic resin fiber tow using a curved surface of one or more friction discs (e.g. No. 2 and No. 3 friction discs) being rotated at the same rotation number as the rotating shaft on which it is disposed, the one or more friction discs having a high friction coefficient relative to the No. 1 friction disc.

The degree of twisting of the interlaced composite yarn while being twisted may be expressed as a twist number, and the twist number means the number of revolutions per meter of the composite yarn. The twist number of the composite yarn according to the present invention is preferably from about 50 turns/meter (T/M) to about 500 T/M, and more preferably from about 100 T/M to about 200 T/M. When the twist number of the composite yarn is less than 50 T/M, the composite yarn with interlaced fibers may lose integrity. On the other hand, when the twist number exceeds 500 T/M, the continuous carbon fiber may be damaged due to excessive twisting because the carbon fiber of the composite yarn is susceptible to shearing force.

In the manufacturing of the composite yarn, the thickness of the composite yarn is not particularly limited. but is preferably from about 2,600 denier to about 60,000 denier. Accordingly, in order to manufacture a composite yarn with the aforementioned thickness, it is preferred that the gap between the friction discs included in each shaft 20 is accordingly adjusted to accommodate the desired thickness.

In addition, when the continuous carbon fiber tow has a filament number from about 25,000 to about 320,000, it is preferred that a continuous carbon fiber/thermoplastic resin fiber composite yarn, in which the continuous carbon fiber and the thermoplastic resin fiber are mixed together, is manufactured by passing the continuous carbon fiber tow through a solution bath including a compatibilizer such as an anionized nylon. Here, it is preferred that the thermoplastic resin fiber is a tow having a continuous fiber form, or a sliver having a staple fiber form. According to embodiments of the invention, when the continuous carbon fiber tow has a filament number of about 25,000 or less, interlacing using a false twist processing machine including a friction disc may be more efficient than interlacing using a solution bath. On the other hand, when the filament number exceeds about 320,000, the continuous carbon fiber tow is so thick that it may be difficult to achieve interlacing by the solution bath.

At this time when the thermoplastic resin fiber has a continuous fiber form, it is preferred that a continuous carbon fiber/thermoplastic resin fiber composite yarn is manufactured by interlacing the continuous carbon fiber tow and the thermoplastic resin fiber tow, and then passing the interlaced fiber through the solution bath.

In particular, it is preferred that the continuous carbon fiber tow and thermoplastic resin fiber tow are introduced into the solution bath by a feed roller and are removed from the solution bath by a take-up roller. At this time, it is preferred that filament spreading of the continuous carbon fiber tow and the thermoplastic resin fiber tow is induced by maintaining the speed of the supplying roller a little faster than the speed of the take-up roller. Furthermore, an agitator may be installed in the solution bath for further facilitating filament spreading of each tow.

When the thermoplastic resin fiber has a staple fiber form, it is preferred that a continuous carbon fiber/thermoplastic resin fiber composite yarn is manufactured by passing the continuous carbon fiber tow through the solution bath, and then interlacing the continuous carbon fiber tow with a thermoplastic resin fiber sliver. At this time, the thermoplastic resin fiber has a length preferably from about 5 mm to about 30 mm and more preferably from about 10 mm to about 20 mm. According to preferred embodiments, an agitator may be installed in the solution bath for facilitating filament spreading of the tow.

Accordingly, when the thermoplastic resin fiber has a continuous fiber form, it is preferred that the thermoplastic resin staple fiber is interlaced with the continuous carbon fiber tow before passing through the solution bath. On the other hand, and when the thermoplastic resin fiber has a staple fiber form, it is preferred that the thermoplastic resin fiber is interlaced with the continuous carbon fiber tow after having passed through the solution bath.

Figure 5:
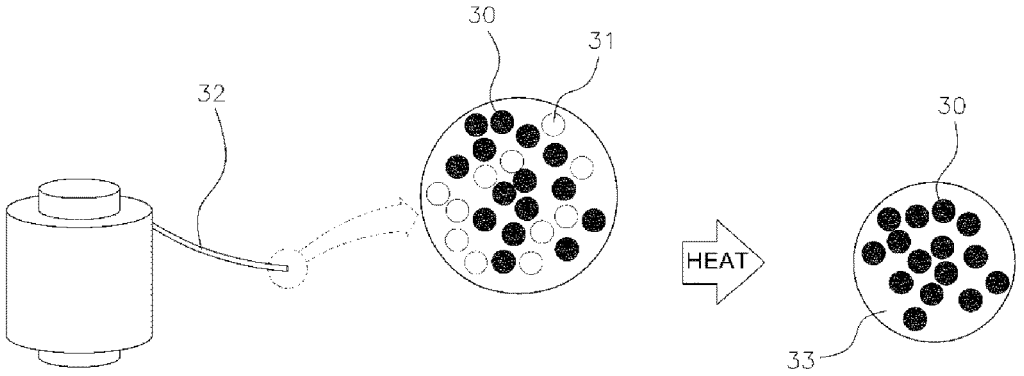
FIG. 5 is a cross-section of the continuous carbon fiber/thermoplastic resin fiber composite yarn and a schematic view of impregnation and solidification by heat according to an embodiment of the present invention.

FIG. 5 is a cross-section of the continuous carbon fiber/thermoplastic resin fiber composite yarn and a schematic view of impregnation and solidification by heat. In particular, winding is suitably performed to provide a required shape using a composite yarn 32 composed of a continuous carbon fiber 30, a thermoplastic resin fiber 31, and the like of the present invention. Then, when heat is added to the wound composite yarn, the thermoplastic resin fiber 31 in the composite yarn may be molten, thereby forming a thermoplastic resin matrix 33. When the molten thermoplastic resin matrix 33 is cooled, the form in which a continuous carbon fiber 30 is positioned in the matrix is obtained, and as a result, the thermoplastic resin matrix 33 becomes a carbon fiber composite material having strong physical properties.

That is, when a desired shape is made using the composite yarn according to the present invention, heat can be added thereto, and then the composite yarn is cooled to thereby manufacture a carbon fiber composite material having a desired shape. Accordingly, the composite yarn may be applied anywhere strong physical properties and a light weight are required. In particular, it is preferred that the composite yarn of the present invention is applied to auto parts, and the like.

Hereinafter, the present invention will be described in more detail through the Examples. These Examples are only for illustrating the present invention, and it will be obvious to those skilled in the art that the scope of the present invention is not interpreted to be limited by these Examples.

Example 1

A continuous carbon fiber tow having a filament number of 25,000 was combined with a nylon 6 having a thickness of 3,200 denier. The combination was then passed through a false twist processing machine including a friction disc composed of three shafts and three pieces, and was interlaced at a twist number of 150 T/M, thereby manufacturing a composite yarn in accordance with the present invention.

Example 2

A continuous carbon fiber tow having a filament number of 50,000 was combined with a nylon 6 having a thickness of 13,300 denier. The combination was then passed through a solution bath including an aqueous solution in which an anionized nylon was dispersed, and then was interlaced. Filament spreading was then facilitated by setting the revolution speed ratio of a feed roller and a take-up roller to 100:99, a twist of 100 T/M was added to the interlaced tow having passed through the solution bath, and then extra solution was removed by passing the interlaced tow through a nip roller, thereby manufacturing a composite yarn in accordance with the present invention.

Example 3

A continuous carbon fiber tow having a filament number of 50,000 was passed through a solution bath including an aqueous solution in which an anionized nylon was dispersed, then a sliver having a thickness of 13,300 denier, which was composed of a nylon 6 staple fiber having an average length of 15 mm, was interlaced with the continuous carbon fiber tow having passed through the solution bath. A twist of 100 T/M was added thereto, and then extra solution was removed by passing the resulting fiber through a nip roller, thereby manufacturing a composite yarn in accordance with the present invention.

Comparative Example 1

A composite yarn was manufactured by interlacing a 10,700 denier fiber having a glass fiber/nylon 6 weight ratio of 100:45.

Comparative Example 2

A 10,700 denier fiber having a carbon staple fiber/nylon 6 staple fiber (average length 20 mm) having a weight ratio of 100:63 was interlaced in the form of a sliver through an open end spinning process, and then a twist of 1,000 T/M was added thereto, thereby manufacturing a composite yarn.

Comparative Example 3

The composite yarn of the Example 1 was interlaced by adding a twist number of 1,500 T/M instead of 150 T/M thereto, thereby manufacturing a composite yarn.

The composite yarns manufactured through Examples 1 to 3 and Comparative Examples 1 to 3 were each arranged and then manufactured in the form of a sheet using a hot press, and then a tensile test was performed in accordance with the ISO 527.

TABLE 1

| Classification | Unit | Example 1 | Example 2 | Example 3 | Comparative Example 1 | Comparative Example 2 | Comparative Example 3 |
|---|---|---|---|---|---|---|---|
| Tensile strength | GPa | 1.91 | 1.83 | 1.87 | 0.91 | 1.63 | 1.46 |
| Tensile modulus | GPa | 102 | 99 | 100 | 34 | 103 | 100 |
| Weight compared to steel | % | 24 | 24 | 24 | 42 | 24 | 24 |

Table 1 compares the tensile test results of Examples to 3 and Comparative Examples 1 to 3. In Table 1, Comparative Example 1 relates to a composite yarn in the related art, which is composed of a glass fiber and a thermoplastic resin fiber. As demonstrated, the tensile strength and tensile modulus of Examples 1 to 3, which were in accordance with the present invention, were about twice and three times higher than those of the Comparative Example 1. Accordingly, it was demonstrated that the composite yarn according to the present invention has better tensile strength and tensile modulus than those of the composite yarn composed of the glass fiber and thermoplastic resin fiber in the related art.

Furthermore, Comparative Example 2 relates to a composite yarn composed of a carbon fiber and a thermoplastic resin fiber. Since the carbon fiber had a staple fiber form instead of a continuous fiber form, a twist number was maintained at a high level in order to bundle the carbon fiber together. As a result, the tensile strength in Comparative Example 2 was lower than those in Examples 1 to 3. Accordingly, it was demonstrated that the composite yarn according to the present invention has better tensile strength than that of the composite yarn composed of the carbon staple fiber and thermoplastic resin fiber in the related art.

Further, in the case of Comparative Example 3, a high twist number was added to the composite yarn in Example 1, and as a result, the tensile strength was reduced by about 24%. Accordingly, when an extreme twist number was added to the composite yarn, it was demonstrated that the damage of the carbon fiber and the twist angle of the carbon fiber is present with respect to the main axis of the reinforced material. As a result, the tensile strength was rapidly decreased.

In addition, since the composite yarn according to the present invention weighs only 24% compared to the weight of steel, which has similar tensile strength and tensile modulus as Examples 1 to 3, it was demonstrated that a light weight effect was provided that is superior to that of steel.

That is, from the Examples, it was demonstrated that the composite yarn according to the present invention has better tensile strength and tensile modulus than those of the composite yarn in the related art, and further, that a light weight effect was provided that is better than steel.

As described above, the present invention has been described in relation to specific embodiments of the present invention, but the embodiments are only illustrations and the present invention is not limited thereto. Embodiments described may be changed or modified by those skilled in the art to which the present invention pertains without departing from the scope of the present invention, and various alterations and modifications are possible within the technical spirit of the present invention and the equivalent scope of the claims which will be described below.

What is claimed is:

1. A continuous carbon fiber/thermoplastic resin fiber composite yarn, comprising:

a carbon fiber; and a thermoplastic resin fiber, wherein the carbon fiber is a continuous carbon fiber having a continuous fiber form, and a plurality of the continuous carbon fibers compose a continuous carbon fiber tow having a filament number from 3,000 to 320,000, wherein the thermoplastic resin fiber is produced from one or more materials selected from the group consisting of polypropylene, polyamide 6, polyamide 66, polyamide 610, and polyester, wherein the thermoplastic resin fiber has an average thickness from about 0.5 denier to about 5 denier, wherein the thermoplastic resin fiber has an aspect ratio from about 100 to 10,000, and wherein the composite yarn has a twist number from about 50 turns/meter (T/M) to about 500 T/M, wherein the continuous carbon fiber/thermoplastic resin fiber composite yarn is manufactured by interlacing the carbon fiber with the thermoplastic resin fiber by a false twist method.

* * * * *